United States Patent [19]

Palmer

[11] 4,097,204

[45] Jun. 27, 1978

[54] VARIABLE DISPLACEMENT GEAR PUMP

[75] Inventor: Walter E. Palmer, Indianapolis, Ind.

[73] Assignee: General Motors Corporation, Detroit, Mich.

[21] Appl. No.: 789,802

[22] Filed: Apr. 22, 1977

Related U.S. Application Data

[63] Continuation of Ser. No. 678,295, Apr. 19, 1976, abandoned.

[51] Int. Cl.[2] ..... F04C 15/04; F04C 1/06

[52] U.S. Cl. ..... 418/19; 418/26; 418/30; 418/170

[58] Field of Search ..... 417/220; 418/19, 20, 418/24, 26, 29, 30, 31, 107, 108, 109, 169, 170

[56] References Cited

U.S. PATENT DOCUMENTS

| | | | |
|---|---|---|---|
| 2,948,228 | 8/1960 | Ahlen | 418/19 |
| 3,491,698 | 1/1970 | Truninger | 418/170 |

*Primary Examiner*—Carlton R. Croyle
*Assistant Examiner*—Leonard Smith
*Attorney, Agent, or Firm*—Donald F. Scherer

[57] ABSTRACT

An internal-external gear pump wherein the fluid displacement thereof is variable. The internal gear is rotatably driven by a drive shaft about a fixed axis and the external gear is rotatably driven by the internal gear about a controlled movable axis eccentric to the fixed axis. Movement of the external gear axis causes the eccentricity between the internal and external gear axes to vary, thereby resulting in a change in the depth of gear tooth mesh such that the volume of fluid displaced by the meshing teeth is varied. The position of the external gear axis is established by a control ring which rotatably supports the external gear, and is mounted in a stationary housing so as to be rotatably positionable within arcuate limits about a fixed axis eccentric to both the axes of the internal and external gears.

2 Claims, 3 Drawing Figures

VARIABLE DISPLACEMENT GEAR PUMP

This is a continuation of application Ser. No. 678,295, filed Apr. 19, 1976, now abandoned.

The present invention relates to fluid pumps and more particularly to internal-external gear pumps having a controlled variable fluid displacement.

It is an object of this invention to provide an improved variable displacement internal-external gear pump wherein displacement is varied by varying eccentricity between the axes of the internal and external gear members.

Another object of this invention is to provide an improved variable displacement internal-external gear pump wherein the internal gear is rotatable about a fixed axis and the external gear is rotatably mounted in a control ring which is positionable within arcuate limits to vary eccentricity between the axes of the gears.

A further object of this invention is to provide an improved variable displacement internal-external gear pump wherein the internal gear is rotatable about a fixed axis and the external gear is rotatably mounted in a control ring on an axis eccentric to the axes of both the control ring and the internal gear, and wherein the space opposite the mesh point of the gear is closed by two sector members one of which is stationary relative to the pump housing and the other is stationary relative to the control ring and wherein the control ring is rotatable within arcuate limits to control the eccentricity between the axes of the internal and external gears.

These and other objects and advantages will be more apparent from the following description and drawings in which.

Figure 1:
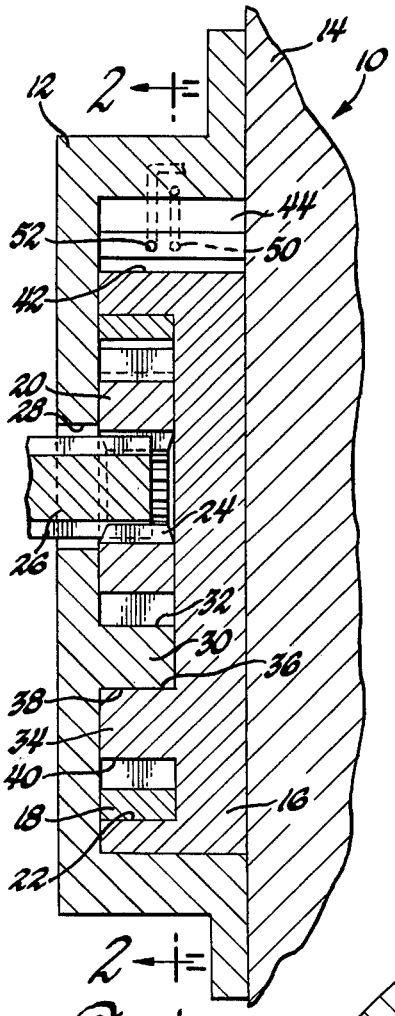
FIG. 1 is a sectional side view of a gear pump.

Referring to the drawings there is shown in FIG. 1 a variable displacement pump 10 having a housing or cover 12 which is secured to a base plate 14. The cover 12 cooperates with the base plate 14 to form an interior closed space in which is disposed a control ring 16, an external gear 18 and an internal gear 20.

The external gear 18 is rotatably mounted in a circular opening 22 formed in the control ring 16. The internal gear 20 is drivingly connected through splines 24 to an input shaft 26 which extends through an opening 28 formed in the cover 12.

Figure 3:
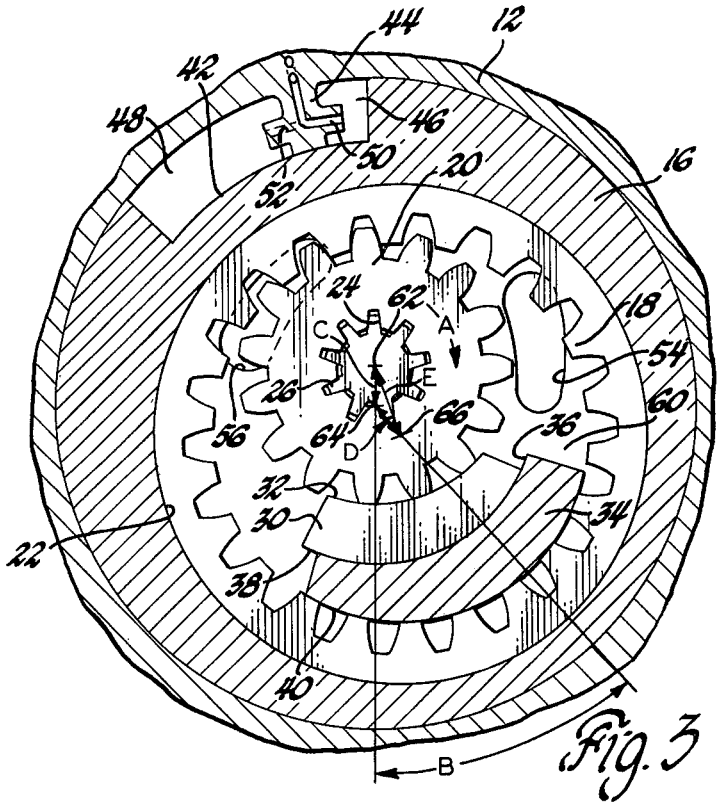
FIG. 3 is a sectional view similar to that shown in FIG. 2 wherein the displacement of the pump has been varied from FIG. 2.
Figure 2:
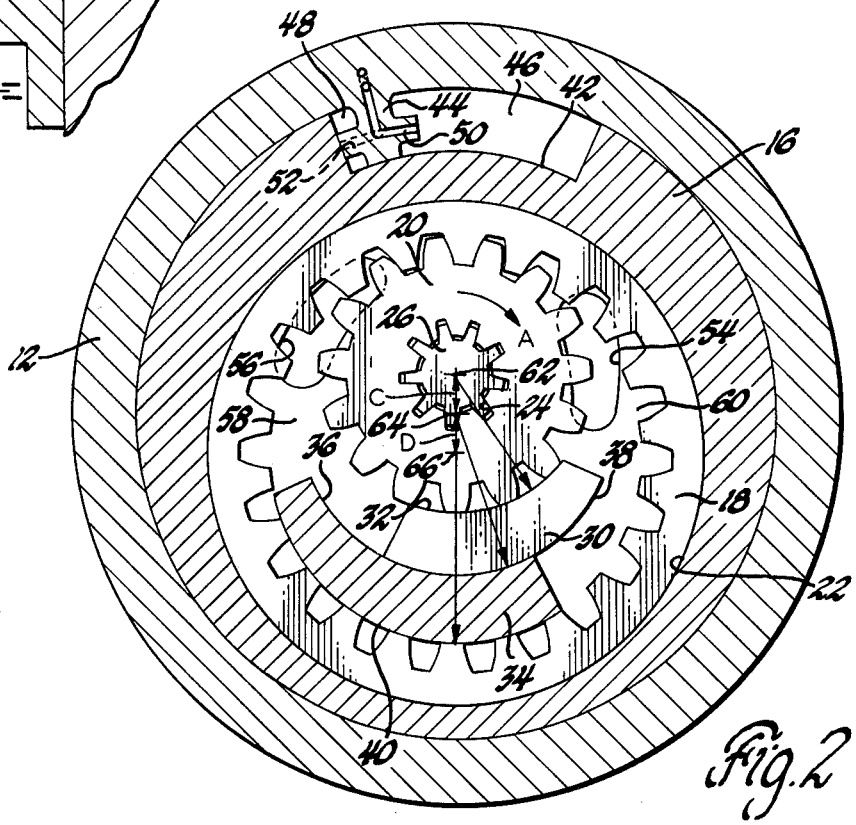
FIG. 2 is a sectional view taken along line 2—2 of FIG. 1.

As best seen in FIGS. 2 and 3 an arcuate segment 30 is formed on the cover 12 and is disposed within the space between the internal gear 20 and the external gear 18. The segment 30 has an inner diameter 32 which is substantially equal to the outer diameter of the internal gear 20. An arcuate segment 34 is formed on the control ring 16, which arcuate segment 34 is also disposed in the space between the internal gear 20 and the external gear 18. The arcuate segment 34 has an inner radius 36 which is equal to the outer radius 38 of the segment 30, and has an outer radius 40 substantially equal to the inner radius of external gear 18.

The control ring 16 has an arcuate recess 42 formed therein in which is disposed a wall member 44 formed integral with or otherwise secured to the cover 12. The wall member 44 cooperates with the recess 42 to form two fluid chambers 46 and 48. A pair of fluid passages 50 and 52 are formed in the wall member 44 and cover 12 such that fluid pressure can be directed to the chambers 46 or 48 through the passages 50 and 52 respectively. The fluid pressure in these chambers 46 or 48 can be selectively controlled by any of the well known control systems which permit control of pump displacement proportional to fluid flow, system pressure, or other external signal. When chamber 46 is pressurized by fluid entering through passage 50 such that the control ring 16 is urged in a clockwise direction as viewed in FIGS. 2 or 3 when chamber 48 is pressurized, through passage 52, the control ring 16 is urged in a counterclockwise direction. In FIG. 2, the pump is at full or maximum displacement, and in FIG. 3, the pump is at minimum displacement.

The fluid flow to and from the pump 10 is through kidney shaped ports 54 and 56 formed in the cover 12. These ports are therefore stationary relative to the control ring 16 which rotates within the cover 12 between arcuate limits as determined by the fluid pressure in chambers 46 and 48. The internal gear 20 has external teeth formed thereon which mesh with internal teeth formed in the external gear 18. As the gears are driven in a clockwise direction, as shown by arrow A, fluid under pressure in the space 58 is discharged through port 56 as the teeth come into mesh and fluid enters the chamber 60 through port 54 as the teeth are withdrawn from their meshing relation. The ports could be formed in the control ring 16 if desired.

In FIG. 2 the axis 62 of gear 20, axis 64 of control ring 16 and axis 66 of external gear 18 are aligned. However as the control ring rotates to the position shown in FIG. 3 it is seen that an angle B is formed between radial lines drawn through axes 62 and 64 and axes 64 and 66. The apex of angle B is located on the axis 64. This represents a change in displacement as a change in eccentricity occurs between the axes 62 and 66. As can be seen in FIG. 3 the amount of mesh of the gear teeth is less than the mesh in FIG. 2 such that less fluid is displaced during rotation of the gears.

The distance between axes 62 and 64 is represented by C and distance between axes 64 and 66 is represented by D. The amount of eccentricity E between axes 62 and 66 is defined by the equation $E = ((C+D\cos B)^2 + (D\sin B)^2)^{\frac{1}{2}}$. When the eccentricity is fixed at the position shown in FIG. 2 the solution for the equation is unity. As the control ring is rotated counterclockwise to the position shown in FIG. 3 the eccentricity decreases as does the pump displacement. By controlling the fluid pressure in chambers 46 and 48 the eccentricity can be controlled between that shown in FIG. 2 and that shown in FIG. 3 to provide a range of operation through which the pump displacement can be varied.

Since the sector 30 is integral with the cover 12 this portion remains stationary during pump displacement changes. The sector 34 is secured to the control ring 16 and therefore rotates through the arcuate movement of control ring 16. Since the radii 36 and 38 are equal and are taken about axis 64 these surfaces of the sectors will remain in sealing engagement during this movement. The radius 40 is established about axis 66 and therefore the radius 40 maintains sealing engagement with the inner radius of gear 18 as is well known in gear pumps. The radius 32 of sector 30 is taken about axis 62 such that this radius surface remains in sealing engagement with the outer radius of the internal gear 20 as is well known in gear pumps. This provides sealing between the chambers 58 and 60 thereby isolating the high pressure side of the pump from the low pressure side of the pump at the point opposite the meshing engagement of the gears.

Obviously, many modifications and variations are possible in light of the above teaching. It is, therefore, to be understood that within the scope of the appended claims the invention may be practiced otherwise than is specifically described.

What is claimed is:

1. An internal-external gear pump comprising; a stationary housing; a drive shaft; an internal gear drivingly connected with said drive shaft and rotatably disposed in said housing for rotation about an axis coincident with the axis of said drive shaft; a control ring rotatably mounted in said housing on an axis eccentric to said internal gear; an external gear rotatably supported in a cylindrical opening of said control ring for rotation about an axis coincident with the axis of said cylindrical opening, the axis of the external gear being eccentric to both said internal gear and said control ring, said external gear having a larger pitch diameter than said internal gear and said gears being in meshing engagement whereby said external gear is driven by said internal gear; the axis of said internal gear, said external gear and said control ring being aligned in a single plane disposed longitudinally of the axis of rotation of said drive shaft when the eccentricity between said internal gear and said external gear is maximum; a stationary arcuate sector portion integral with said housing disposed in the space between said gears substantially opposite the mesh point of said gears and having an inner radius substantially equal to and disposed adjacent the outer radius of said internal gear and an outer radius eccentric to its inner radius; an arcuate control sector portion integral with said control ring disposed in the space between said gears adjacent the outer periphery of said stationary sector portion, having an inner radius substantially equal to the outer radius of said stationary sector portion and an outer radius substantially equal to and disposed adjacent the inner radius of said external gear; and means for rotating said control ring, control sector and external gear through an arc about the axis of said control ring relative to said stationary housing whereby the eccentricity between said gears is altered so that the fluid displaced by the meshing gears varies as the eccentricity is altered.

2. An internal-external gear pump comprising; a stationary housing; a drive shaft; an internal gear rotatably disposed in said housing and being drivingly connected with and axially aligned with said drive shaft; a control ring rotatably mounted in said housing on an axis eccentric to said internal gear by a predetermined distance (C); an external gear rotatably mounted on said control ring and having an axis eccentric to said internal gear by a controlled distance (E) and eccentric to said control ring by a predetermined distance (D), said external gear having a larger pitch diameter than said internal gear and said gears being in meshing engagement whereby said external gear is driven by said internal gear; a stationary arcuate sector portion integral with said housing disposed in the space between said gears substantially opposite the mesh point of said gears and having an inner radius substantially equal to and disposed adjacent the outer radius of said internal gear and an outer radius eccentric to its inner radius; an arcuate control sector portion integral with said control ring disposed in the space between said gears adjacent the outer periphery of said stationary sector portion, having an inner radius substantially equal to the outer radius of said stationary sector portion and an outer radius substantially equal to and disposed adjacent the inner radius of said external gear; and means for rotating said control ring, control sector and external gear through an arc about the axis of said control ring relative to said stationary housing whereby the eccentricity between said gears is altered so that the fluid displaced by the meshing gears varies as the eccentricity is altered such that at maximum displacement the controlled distance (E) equals distance (C) plus distance (D), and when the displacement is varied to less than the maximum the axes of the external gear and the control ring are aligned on one radial line and the axes of the internal gear and external gear are aligned on another radial line whereby an angle (B) is formed between the radial lines having the apex thereof on the axis of the internal gear so that the controlled distance (E) is determined by the following equation, $E = ((C + D \cos B)^2 + (D \sin B)^2)^{\frac{1}{2}}$.

* * * * *